United States Patent [19]

Snygg

[11] Patent Number: 4,934,619

[45] Date of Patent: Jun. 19, 1990

[54] METHOD AND APPARATUS FOR WINDING A WEB

[75] Inventor: Keijo Snygg, Karhula, Finland

[73] Assignee: Valmet-Ahlstrom, Inc., Karhula, Finland

[21] Appl. No.: 313,373

[22] Filed: Feb. 21, 1989

[30] Foreign Application Priority Data

Feb. 22, 1988 [FI] Finland ..... 880822

[51] Int. Cl.[5] ..... B65H 18/16; B65H 19/28

[52] U.S. Cl. ..... 242/56 R; 242/65

[58] Field of Search ..... 242/56 R, 65

[56] References Cited

U.S. PATENT DOCUMENTS

| | | | |
|---|---|---|---|
| 2,935,272 | 5/1960 | Schmitz | 242/65 |
| 3,191,883 | 6/1965 | Wells | 242/56 R |
| 4,783,018 | 11/1988 | Rodriguez | 242/56 R |
| 4,789,109 | 12/1988 | Kyytsonen | 242/56 R |

FOREIGN PATENT DOCUMENTS

| | | | |
|---|---|---|---|
| 240229 | 12/1960 | Australia | 242/65 |
| 2721883 | 11/1978 | Fed. Rep. of Germany | 242/56 R |
| 2050317 | 1/1981 | United Kingdom | 242/56 R |

*Primary Examiner*—Joseph J. Hail, III

*Attorney, Agent, or Firm*—Cohen, Pontani & Lieberman

[57] ABSTRACT

A method and apparatus for on-machine winding of a web, including a Pope reeling drum (10) and a reel spool (11). The web (W) to be wound passes over the drum. An empty reel spool (11') is brought into the grip of primary arms in such a way that bearing members (25) of the reel spool (11') are supported by guiding elements located at both sides of the drum (10) in such a manner that the reel spool (11') is not engaged with the drum (10). The empty reel spool (11'), preaccelerated to winding speed, is then brought into nip contact with the rotating reel drum (10), by moving the spool into recesses (21) in the guiding plates thereby forming a nip (10) through which the web (W) passes. The web breaks off and begins to wind onto the empty reel spool (11).

11 Claims, 3 Drawing Sheets

METHOD AND APPARATUS FOR WINDING A WEB

The invention relates to a method for on-machine winding of a web in which a Pope-type reel-up or the like is used, over which the web to be wound passes and in which a so-called centre drive is mainly applied whereby a reel spool is driven through a coupling at one end of the reel spool, and in which method new reel spools are brought into connection with a reeling drum, after which the web is conducted from a completed roll to a new reel spool to be reeled up on it.

The invention also relates to an on-machine winder by means of which a web coming from a paper machine or other web making machine is wound on reel spools; the apparatus comprising a driven reel-up drum and primary arms in connection with it, which bring the empty reel spools onto the winder; and secondary arms, supported on which the reel builds up, at least at its final stage.

As is previously known, the so-called Pope-type reel-up is commonly used for reeling up a paper web coming from a paper machine or a printing machine, in which the roll is wound on a reel spool and the roll thus built up is pressed against a drive drum, or a so called Pope reeling drum, touching which the web partly runs and which is rotated at a peripheral speed matching the speed of the web. Prior to the completion of the roll, the new empty reel spool can be brought into contact with the drive drum in order to reach the matching peripheral speed. As soon as the paper roll has reached the desired diameter, it is moved free from the drive drum. Its rotation speed starts to slow down, which causes the web to form a slack sling between the new reel spool and the completed roll. This sling is then guided to wind round a new reel spool as by pressure air jets or other suitable means, whereby it naturally tears off the completed roll.

As is previously known, the shaft of the paper roll, i.e., the reel spool, is usually supported and rotates on two rails. For this purpose both ends of the reel spool are provided with special bearing means, which also guide the path of the roll when, on completion, it is transferred along the rails for further treatment. In paper making this further treatment usually means slitting and rewinding the roll into smaller ones. For returning and changing the empty reel spools, e.g., a crane can be used.

Especially when winding paper webs at higher speeds, a problematic phenomenon occurs, namely wrinkling in the inner layers of the roll, because of which the inner portion of the roll has to be rejected. The percentage of broke can be as high as 2–3%, which means considerable economical loss for the paper mill. The main reason for the wrinkling phenomenon is considered to be the variations in hardness (density) which occur in the inner portions of the paper roll. Variations in hardness are mostly caused by uncontrolled variations of the linear load as well as variations in the tension of the paper web to be wound.

The most critical step in winding is when the growing roll is transferred from the primary arms onto the secondary arms. In practice, considerable variation occurs in the linear load at this point. This results in occasional wrinkling of the paper at the initial stages of winding as described above. The transfer of the roll from the primary arms to the secondary arms may also cause variation in density of the paper, which also causes the paper to wrinkle, or even to tear off.

A previously known way to prevent the problems described above is to set the web at the highest possible tension but, as said before, a restrictive factor is the tendency of the web to break and the deterioration of the quality of the paper being produced, as then, e.g., the breaking strength and stretch at break decrease.

Previously known means is also to raise the linear load as high as possible by using an excessively high load in the supporting arms, especially the secondary arms, by means of which the roll is pressed against the reeling drum. This method also has the drawback of deterioration of the quality of the paper being produced, as particularly the breaking strength and stretch at break decrease, as in the above method. Paper qualities which cannot be allowed to be pressed against a Pope reeling drum can be treated by the apparatus according to this invention. One of these paper qualities is the A-COPY ® paper for self-copying, which has so-called micro capsules inside the paper.

When the reel spool is brought into contact with the Pope reeling drum, it is usually done by means of arms, the reel spool pressing against the surface of the web, and thus causing broke to be produced for about half a minute. As the speeds of the paper webs are about 1000 m/min, the portion of broke produced is considerable and this causes substancial economical loss.

It is the object of the present invention to provide a method and apparatus for winding a web, in which the transfer of the web from one reel spool to another can be done very speedily so that the time during which the reel spool touches the Pope reeling drum is considerably reduced, even to only a few seconds.

In order to accomplish this, the method according to the invention is mainly characterized in that the method comprises, in combination, the following steps:

(a) an empty reel spool is brought into the grip of the primary arms in the way that the bearing members at both ends of the reel spool are being supported by guiding elements at each end of the reeling drum in such a manner that the outer shell of the reel spool is not engaged with the reeling drum, (b) the empty reel spool, preaccelerated to winding speed and guided by the guiding elements and primary arms, is brought into nip contact with the rotating reeling drum, the web to be wound running through the nip, (c) due to the nip contact mentioned above, or only after it, the web breaks off or is severed, whereby the web begins to wind onto the empty reel spool, the winding being continued by means of centre drive of the reel spool and/or nip drive by the reeling drum until the roll is fully wound, after which the above steps are repeated.

The apparatus according to the invention for achieving the object described above is characterized in that the winder comprises guiding plates disposed adjacent both ends of the reeling drum, which plates have curved guiding peripheries, which mainly follow the periphery of the reeling drum, each guiding plate having a recess deviating from its general shape, directed towards the centre of the reeling drum, and disposed in such a way that when the bearing housings of the empty reel spool, guided by the primary arms, come to said recesses the outer periphery of the empty reel spool is brought into nip contact with the outer periphery of the reeling drum, due to which contact, or after it, the web is torn or cut off and is then transferred to wind from the full roll onto the empty reel spool, after which the primary arms immediately continue their journey and the effect of the recesses of the guiding plates ceases, whereby the reel spool is disengaged from the Pope reeling drum while continuously receiving the paper web.

The motion of the primary arms is continued and the guiding plate disengages the reel spool from the nip contact once more while the reel spool is already receiving paper web. At this point the changing of the reel spools and conducting the web onto a new reel spool is completed and the full roll can now be further treated without haste caused by the exchange of the reel spools.

As the web is very quickly conducted to wind onto a new reel spool and it is preferably cut off at the same moment as the reel spool comes into contact with it, the time for broke to be produced is very short, even only 3 to 5 seconds.

The web can be cut in various ways, the most preferred of them in this embodiment being the so called adhesive tape cutting method, which is performed in such a way that the web adheres to and is torn off by a double-sided adhesive tape, which is wound or attached in some other way around the reel spool.

The web can also be cut by the conventional balloon blowing method, in which air is blown on the nip between the reel spool and the Pope winder, which causes the web to rise upward and form a "balloon", break from the impact of air, and transfer to wind round a new reel spool. Previously known cutting methods are also edge blowing, or using a sharp-pointed object to make a hole in the web before blowing, and/or the use of a cord cutting device. This is important when applying an apparatus according to the invention on an old Pope winder.

For carrying out the invention, a so called centre winder is generally used, which has drive means, e.g., direct current motors, one for the reel spool on the primary fork and one for the reel spool on the rails.

When a paper reel has reached its full size, the secondary arms remove it and the primary arms transfer a new reel spool, located in the recesses of the guiding plates and already receiving paper web, further downwards onto the rails at the same time disengaging it from the Pope reeling drum to a distance of, e.g., 10 to 30 mm, depending on the paper quality being run. The winding is then continued on the rails, where the reel spool is driven by a drive motor of its own, the roll no longer touching the Pope reeling drum. The wrinkling of the paper, and consequently, the deterioration of the quality of the paper is thus prevented.

In one embodiment of the invention, nip drive can also be used, in which the winding is performed with the reel spool in contact with the Pope reeling drum. If the guiding plate according to the invention is provided with a retracting device, a conventional drive means based on nip contact can be chosen, whereby the drive motor of the reel spool does not provide the driving torque.

In the method according to the invention, when a new reel spool is being brought into contact with the web on the surface of the Pope reeling drum, it is conducted into the recesses on the stationary guiding discs or plates attached to the sides of the Pope reeling drum. The reel spool is now supported on the primary arms through its bearing housing and, longitudinally, on the surface of the Pope reeling drum, but disengaged from the guiding plates.

The guiding plates disposed at the sides of the Pope reeling drum may extend along the entire periphery of the drum, but only a certain portion of the periphery is in use, i.e. the portion where the reel spool is transferred to the winding position. The rest of the plate is constructed in accordance with fixing points and other functions, e.g., protecting functions.

The winding apparatus according to the invention can be provided with an auxiliary device for moving the guiding plate or part of it out of the way. The winding is then performed by nip drive instead of centre drive, in other words, the winder functions in a prior art mode.

Considerable savings can be made by using a solution according to the invention. The time for producing broke being only 3 to 5 seconds means that the broke can even be cut down to 10% of the broke produced by known methods and apparatus.

The invention is meant to be used in paper machinery, particularly in on-machine winding, but can also be used for other purposes. When the invention is used in a paper machine, it is especially suitable when making expensive paper qualities, whereby the savings are the most sizeable. The auxiliary device according to the invention, by means of which the guiding plates located at the sides of the Pope reeling drum can be moved out of the way and centre drive mode switched to nip drive mode when needed, can also be used to shift from centre drive to surface drive if desired, e.g., when starting to run less expensive paper qualities or when training operation personnel.

The method according to the invention is very reliable, as the transfer of the fully wound roll can be performed sufficiently slowly to avoid too high accelerations and thus extreme dynamic forces leading to wear of parts and malfunction of apparatus.

Even though the invention is here described referring to on-machine winders in paper machines, it has to be pointed out that the method and apparatus according to the invention is suitable for using for other purposes, such as on-machine winding of plastic films or the like.

In the following, the invention is described in detail referring to the figures of the drawings which illustrate certain embodiments of the invention whose details do not by any means strictly limit the invention.

In the following the function of a winder in general, and a known embodiment of it are presented.

Figure 1:
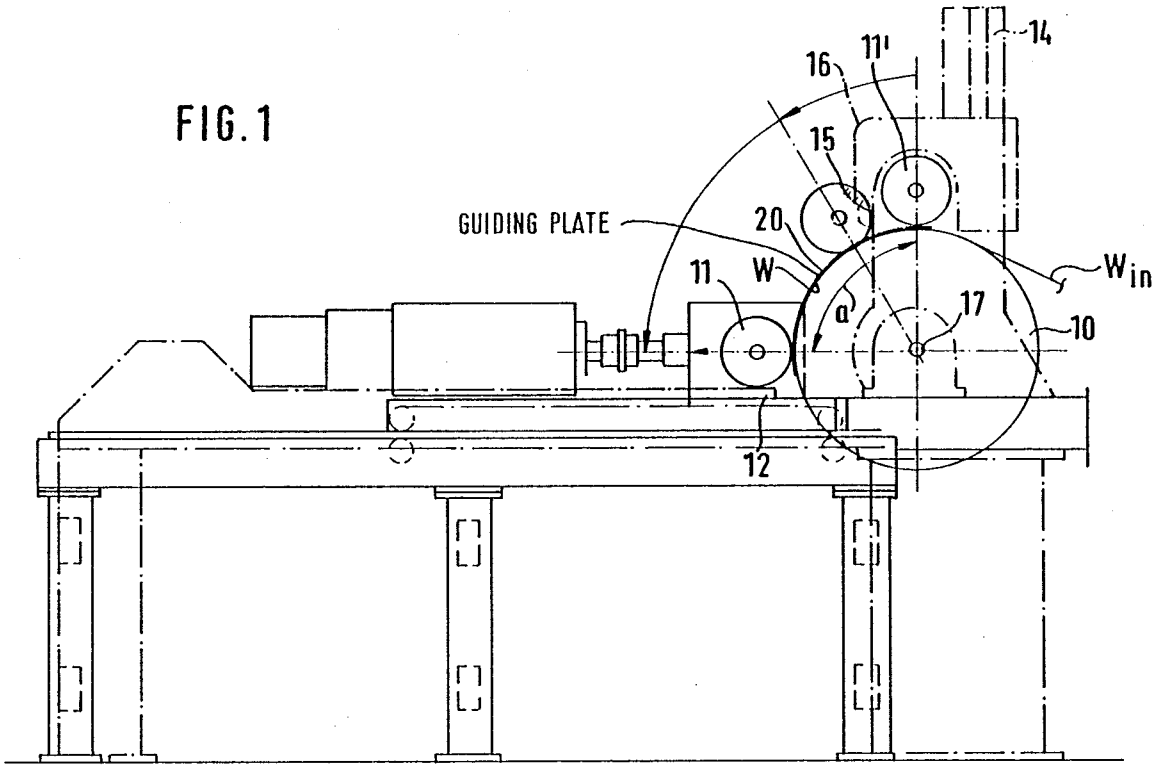
FIG. 1 is a general view of the winder, where the invention is seen from the side of the machine.

The main part of the Pope winder, schematically shown in FIG. 1, is a reeling drum 10, along the periphery of which the paper web W travels for a little over a quarter of a revolution before passing onto the periphery of the paper roll building up on a reel spool 11. The reel spool 11 rotates supported by two supporting rails 12, secondary arms (not shown) pressing it against the reeling drum 10. The secondary arms also disengage the paper roll from the reeling drum 10, when the roll has reached the desired diameter.

The finished paper rolls are transferred along the supporting rails 12 for further treatment and the empty reel spools are returned e.g. onto storing rails (not shown) disposed above the supporting rails 12.

The transfer means for the reel spool 11 comprises guiding bars 14 extending upwards from the sides of the reeling drum 10 and pivotally mounted on bearings at their lower ends and, moving up and down from each guiding bar, gap sledges, into whose gaps between the lower 15 and upper 16 jaws the bearing members of the reel spool 11 can be enclosed. The parts 14,15 and 16 form the so called primary arms. This invention relates to a winding technique where a so-called centre drive is preferably applied, wherein the reel spool 11 is driven through a coupling 30 attached to one or each of its ends.

When replacing the reel spool 11 the lower jaws 15 are raised to the level of the ends of auxiliary rails (not shown) and the upper jaws 16 are raised to their upper position (not shown). Simultaneously the guiding bars 14 are rotated by drive means (not shown in FIG. 1) into such a position that no gap is left between the lower jaw 15 and the end of the auxiliary rail. The reel spool is allowed to roll from its upper position (not shown) into the gaps of the jaws 15,16, which are closed by lowering the upper jaws. The lower jaws 15 are lowered so as to bring the periphery of the reel spool close to (not into contact with) the periphery of the reeling drum 10, whereafter the guiding bars 14 are pivoted in the rotational direction of reeling drum 10.

In previously known solutions, the guiding bars 14 being eccentrically mounted in bearings the distance between the reel spool 11 and the reeling drum 10 is further diminished until the reel spool 11 touches the paper web travelling on the reeling drum 10 and reaches a peripheral speed matching that of the web. The transfer of web W onto a new spool can now be performed in the previously known fashion and a successive reel spool can be lowered onto the supporting rails to replace the previous one. During the exchange, which is performed at the point where the reel spool presses against the web, broke is produced for about 30 seconds.

The construction and function of the reeling drum described above is well-known in the prior art and this description is only meant to facilitate the understanding of the invention and its background. It should be pointed out that the present invention can be applied to winders of widely different types, also to off-machine apparatus, whose construction and function considerably differ from that of FIG. 1.

In the following, an embodiment of the invention and its function is described in detail.

In accordance with this invention, a guiding plate 20 is placed at both ends of a reeling drum 10, which may extend along the entire periphery of the reeling drum 10, or only a desired portion of the same. In any case, only the section a of the periphery of the drum 10 is essential from the point of view of the invention, as the invention is solely concerned about that section of the plate. The construction of the remaining portion of the plate depends on other factors, such as fixing points and, e.g., its protecting or other functions. There is a pair of guiding plates 20, spaced adjacent both ends of the drum respectively. Guiding plates 20 have a curved guiding surface, which mainly follows the periphery of the reeling drum 10. The guiding plates 20 are provided with recesses 21, which smoothly deviate from the general shape of the plate 20 inwardly towards the centre of the reeling drum 10.

A successive empty reel spool 11 is brought to the reeling drum 10 and placed above it in such a manner that bearing housings 25 at both ends of the reel spool 11 are supported by guiding elements 15,16 located at both ends of the reeling drum 10, in such a way that the outer shell of the reel spool 11 is not in contact with the reeling drum 10.

The empty reel spool 11' can already be accelerated to winding speed at this point and then be transferred, guided by the guiding elements 15,16 and primary arms, to the recesses 21, with its bearing housings situated at their respective recesses. The outer periphery of the empty reel spool 11' is similarly brought into nip engagement with the outer periphery of the reeling drum 10, through which nip the web to be wound passes.

Figure 2:
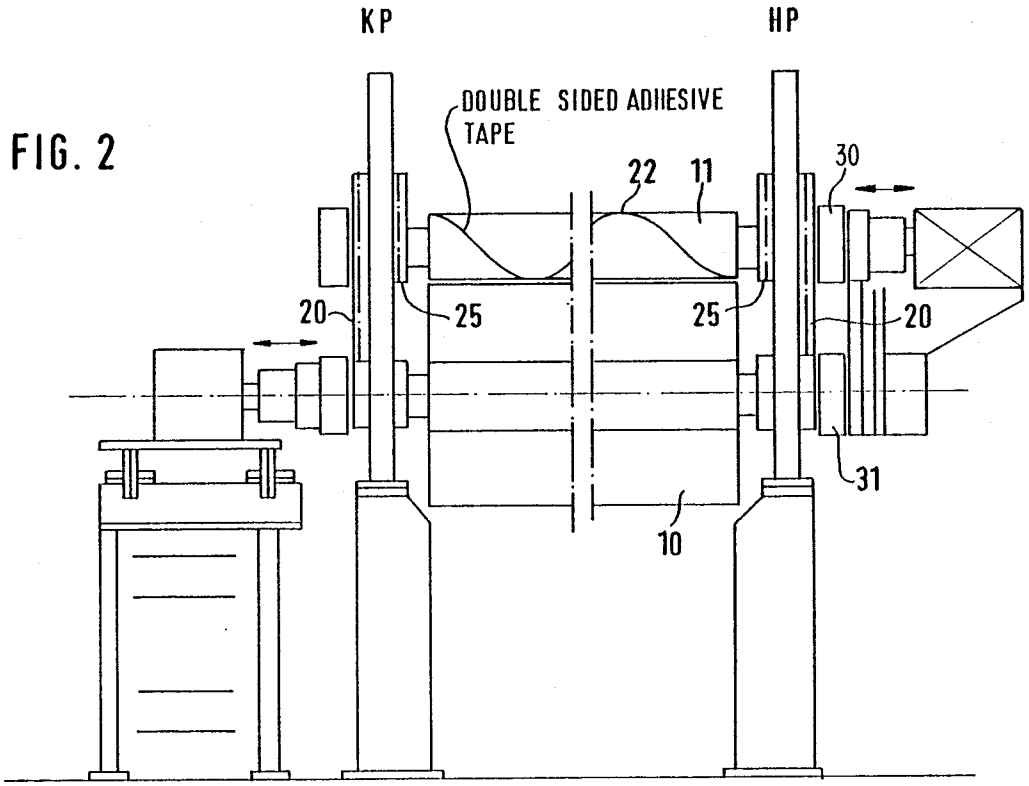
FIG. 2 is an end view of a winder according to FIG. 1.

The web W may be severed and led to wind onto a new spool as an immediate consequence of the nip contact. In this preferred embodiment, adhesive tape has been applied to the reel spool 11', wrapped around the spool as shown in FIG. 2, upon which the web W adheres and is immediately torn off due to the nip contact.

The cutting off of the web may also be performed conventionally, in prior art manner, as by balloon or edge blowing or by cord cutting means after bringing the web into nip contact.

After the cutting operation, in a first embodiment of the invention, the web W starts to wind onto the empty reel spool 11', and the winding is continued by centre drive, whereby it is driven through a coupling at one end of the spool.

In a second embodiment of the invention the winder is equipped with an auxiliary device 29, by which guiding plates 20 are removed out of the way after severing the web W, and the winding is continued by nip drive until the roll is wound to size, and the aforesaid steps are repeated. Thus the winder can be used in two alternative ways.

In FIG. 2 the winder according to the invention is shown in and view of machine direction, where reeling drum 10, reel spool 11 and guiding plates 20 are seen. Double-sided adhesive tape 22 for cutting the web has been applied around reel spool 11 as shown in FIG. 2. The winder according to the invention is provided with drive motors for the reeling drum 10 and the reel spool 11. Reference numeral 25 refers to the bearing housings of the reel spool 11, which are located at the recesses 21. Reference numeral 31 refers to the couplings of the reeling drum. The walkway side and the drive side of the winder are referred to by respectively HP and KP.

Figure 3:
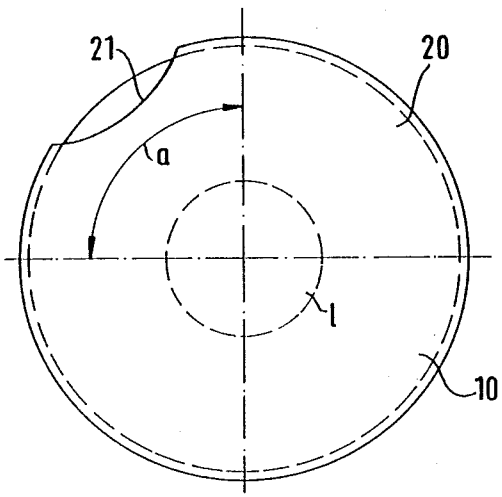
FIG. 3 is a partial view of a Pope reeling drum and a guiding plate disposed at the outside of its ends, such a guiding plate being disposed at each end of the Pope reeling drum.

FIG. 3 is a partial view of the reeling drum of a winder, which shows one of the guiding plates 20 disposed on it, here extending along the entire periphery. The portion of the plate inside line 1 is not shown as its design varies according to the manner in which it is mounted, and, furthermore, this portion of the plate is not essential from the point of view of the invention. The plate may also be mounted in the way that the whole plate or part of it is pivoted enabling thus the recess to move along the periphery of the Pope reeling drum. FIG. 3 also shows the recess 21 in the plate for the bearing housings 25 of the reel spool 11.

Figure 4:
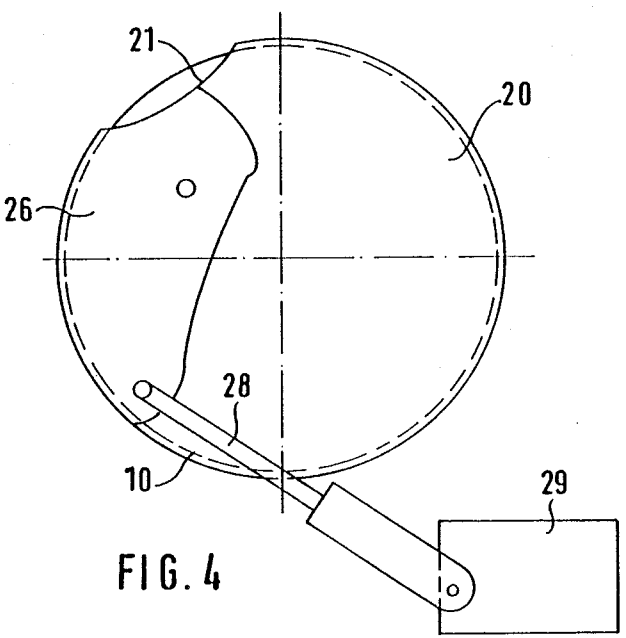
FIG. 4 is a partial view of another embodiment of the invention, where the end part of the guiding plate can be moved away out of function so as to enable the adoption of the conventional surface drive principle.

FIG. 4 shows an embodiment where the winder is provided with an auxiliary device. In this realization of the embodiment with an auxiliary device as shown in FIG. 4, an auxiliary plate 26 is mounted on the guiding plate 20, by means of which the guiding plate 20 can be moved off position after nip contact. Plates 20,26 have now been connected with an actuator 29 through a rod 28.

As stated before, the guiding plate 20 may also be of a different design from those shown in FIGS. 3 and 4.

The invention is defined in the following claims, and the details of the invention may vary within the scope of the inventional concept.

What is claimed is:

1. A method for on-machine winding of a web (W) in which the web to be wound passes over a reeling drum (10) and including a reel spool (11) driven by a center drive connected thereto by a coupling at one end thereof and in which successive reel spools (11') are brought into engagement with the reeling drum whereafter the web is directed away from a fully wound roll and onto an empty reel spool for winding thereon, the method comprising the steps of:

(a) bringing an empty reel spool (11') having bearing housings (25) into operative engagement with primary arms;

(b) supporting the bearing housings (25) located at both ends of the reel spool (11') by curved guiding elements so that the outer shell of the reel spool (11') is not engaged with the reeling drum (10);

(c) accelerating the empty reel spool to winding speed;

(d) bringing the reel spool into temporary nip contact with the rotating reel drum for transferring said web to said reel spool by guiding said bearing housings (25) into respective recesses (21) provided in the periphery of said curved guiding elements (20);

(e) severing the web (W);

(f) initiating the winding of the web (W) on the reel spool (11'); and thereafter (g) disengaging said reel spool from said nip contact with said reel drum (10) by supporting said bearing housings on said guiding elements during continuation of winding of the web onto the reel spool.

2. The method of claim 1, wherein the web is severed by nip contact.

3. The method of claim 1, wherein the reel spool is disengaged from the reeling drum (10) by a distance of about 10 to about 30 mm.

4. In an apparatus for winding a web from a web making machine onto a reel spool having a driven reel drum (10), primary arms for bringing the empty reel spools (11') having bearing housings to the winder, the improvement comprising:

guiding plates (20) for the bearing housing of the empty reel spool, the plates being disposed at both ends of the reeling drum and having a curved guiding periphery substantially following the periphery of the reeling drum; a recess within each guiding plate, the recess being directed towards the center of the reel drum so that the bearing housing (25) of the empty reel spool (11'), as said bearing housing (25) moves over said guiding periphery, engages in said recess causing temporary nip contact between the outer periphery of the empty reel spool and the outer periphery of the reeling drum for transferring said web to said reel spool and then the reel spool is again supported by the curved guiding periphery of the guiding plates out of contact with the reel drum during continued winding of the web onto the reel spool.

5. The apparatus according to claim 4, wherein the guiding plate extends along the entire periphery of the reeling drum (10).

6. The apparatus according to claim 4, wherein reeling drum has a frame and the guiding plate is affixed to the frame of the reeling drum (10).

7. The apparatus according to claim 4, wherein the guiding plate is rotatably mounted so that the recess on the periphery thereof is movable along the periphery of the reeling drum (10).

8. The apparatus according to claim 4, wherein said guiding plates are movably mounted between a first position and a second position, and additionally comprising means for bringing said guiding plate into said first position in which the outer periphery of the reeling spool is in contact with the outer periphery of the reeling drum and into said second position in which there is no contact between the outer periphery of the reeling drum and the outer periphery of the reeling spool.

9. The apparatus according to claim 4, additionally comprising means for severing the web at or after the nip contact between the reeling spool and the reeling drum.

10. The apparatus according to claim 9, wherein the severing means comprises double-sided adhesive tape.

11. An apparatus for winding a web (W) from a web making machine comprising:

a driven reeling drum supporting the web;

a reeling spool having a bearing housing at both ends thereof;

a guiding plate disposed at each end of the reeling drum substantially perpendicularly to the axis thereof for guiding the bearing housing of the reel spool, each guiding plate having a curved guiding periphery substantially following the periphery of the reeling drum;

a recess within each guiding plate so that the bearing housing of the empty reel spool, as said spool is moving along said guide plate, engages therein so that there is temporary nip contact between the outer periphery of the reeling spool and the outer periphery of the reeling drum for transferring said web to said reeling spool, the remainder of the curved guiding periphery of the guiding plate being shaped so that as said spool is continuing its movement along said guide plate after said nip contact for continued take up of said web about said spool, said spool is disengaged from said reeling drum while the bearing housing of said reel spool is in contact with said curved guiding periphery.

* * * * *